United States Patent [19]

Malmström

[11] 4,029,317

[45] June 14, 1977

[54] GAMES RACKET

[76] Inventor: Sven Erik Malmström, 11 Dammweg, 3904 Naters, Switzerland

[22] Filed: Sept. 5, 1975

[21] Appl. No.: 610,880

[30] Foreign Application Priority Data

| | | |
|---|---|---|
| Sept. 9, 1974 | Sweden | 7411333 |
| Aug. 11, 1975 | Sweden | 7508985 |

[52] U.S. Cl. ..... 273/73 C; 273/73 D; 273/73 J

[51] Int. Cl.[2] ..... A63B 49/02; A63B 51/16

[58] Field of Search ..... 273/73 R, 73 A, 73 C, 273/73 D, 73 E, 73 F, 73 H, 73 J

[56] References Cited

UNITED STATES PATENTS

| | | | |
|---|---|---|---|
| 1,587,918 | 6/1926 | Morrison | 273/73 H X |
| 1,862,581 | 6/1932 | Robinson | 273/73 E X |
| 1,954,327 | 4/1934 | Panker | 273/73 D |
| 2,307,470 | 1/1943 | Salathe | 273/73 D X |
| 3,810,620 | 5/1974 | Decker et al. | 273/73 H |
| 3,833,218 | 9/1974 | Frenkel et al. | 273/73 J |
| 3,833,219 | 9/1974 | Dean | 273/73 J X |
| 3,834,699 | 9/1974 | Pass | 273/73 D |

FOREIGN PATENTS OR APPLICATIONS

| | | | |
|---|---|---|---|
| 873,489 | 6/1971 | Canada | 273/73 D |
| 1,043,897 | 11/1958 | Germany | 273/73 D |
| 2,717 | 2/1909 | United Kingdom | 273/73 D |
| 331,925 | 7/1930 | United Kingdom | 273/73 D |

*Primary Examiner*—Richard J. Apley
*Attorney, Agent, or Firm*—McGlew and Tuttle

[57] ABSTRACT

A tennis racket and a method of manufacturing same are disclosed. The racket comprises two half-frame members each provided with a respective generally annular portion defining a rim element of the racket, and also provided with a handle portion connected to the respective generally annular portion. The face of the racket is formed by a plurality of tensioned strings clamped between the annular portions to define a netting. The netting is secured to each of the rim elements of the respective half-frame members by binders, which also secure the two rim elements to one another. The strings are subjected to tension by a tensioning device before the two rim elements of the racket are pressed together to clamp the strings therebetween and the strings are secured to the rim elements and the latter to one another by binders, which have been applied to at least the mutually facing surface portions of the rim elements prior to their being pressed together.

6 Claims, 4 Drawing Figures

GAMES RACKET

BACKGROUND OF THE INVENTION

The present invention relates to a games racket such as a tennis racket.

A tennis racket must provide a hard-tensioned net of great elasticity. Furthermore, the frame of the racket must have great rigidity, especially torsional stiffness, so that the racket may prove to be durable and may be capable of absorbing large instantaneous loadings.

A known racket displays a frame provided with openings. A cord forming strings of the racket is continuously drawn into the openings. This racket has the disadvantage that it is relatively expensive to manufacture. Initially, the frame must be manufactured and then it must be provided with such openings. In wood framed rackets, the openings for the strings are formed with a drill and these openings must subsequently be deburred to avoid damage to the strings. The drilling and subsequent deburring requires a considerable time. Later, the strings are drawn in and tensioned. Since the strings in most cases are drawn in manually, this operating step is also very time consuming. The manufacturing of the frame and the drawing in of the strings are often carried out at different localities, so that intermediate transport facilities for transporting the frames to the locality at which they will be strung is required, thus further increasing manufacturing costs. The manual drawing in of the strings also has the disadvantage that the strings are often differently tensioned.

Many previously known rackets have the disadvantage that their handles are either very stiff or are insufficiently strong. Too stiff a handle may impair the performance of a player and may lead to damage of his or her elbow, such as the formation of the so-called "tennis elbow".

It is an object of the present invention to provide a racket, which is relatively cheap to manufacture and in which the strings can be rapidly and uniformly tensioned.

It is a further object of the present invention to provide a racket with a slightly resilient handle, but without thereby impairing the strength of the racket.

SUMMARY OF THE INVENTION

According to one aspect of the present invention, there is provided a method of manufacturing a games racket comprising the steps of applying tension to a plurality of strings by a tensioning device and clamping the strings between two generally annular portions of respective racket frame members, while employing binding means to secure the strings to each of the two generally annular portions and to secure the latter to one another.

According to another aspect of the present invention, there is provided a games racket comprising two frame members each provided with a respective generally annular portion and with a handle part connected with the respective annular portion and a plurality of tensioned strings clamped between the annular portions to define a netting, each of the generally annular portions being secured to the respective other portion and to the netting by binding means.

BRIEF DESCRIPTION OF THE DRAWINGS

An embodiment of the present invention will now be more particularly described by way of example with reference to the accompanying drawings, in which:

FIG. 1*b* is a sectional view, to an enlarged scale, of a portion of FIG. 1*a.

DESCRIPTION OF THE PREFERRED EMBODIMENTS

Figure 1:
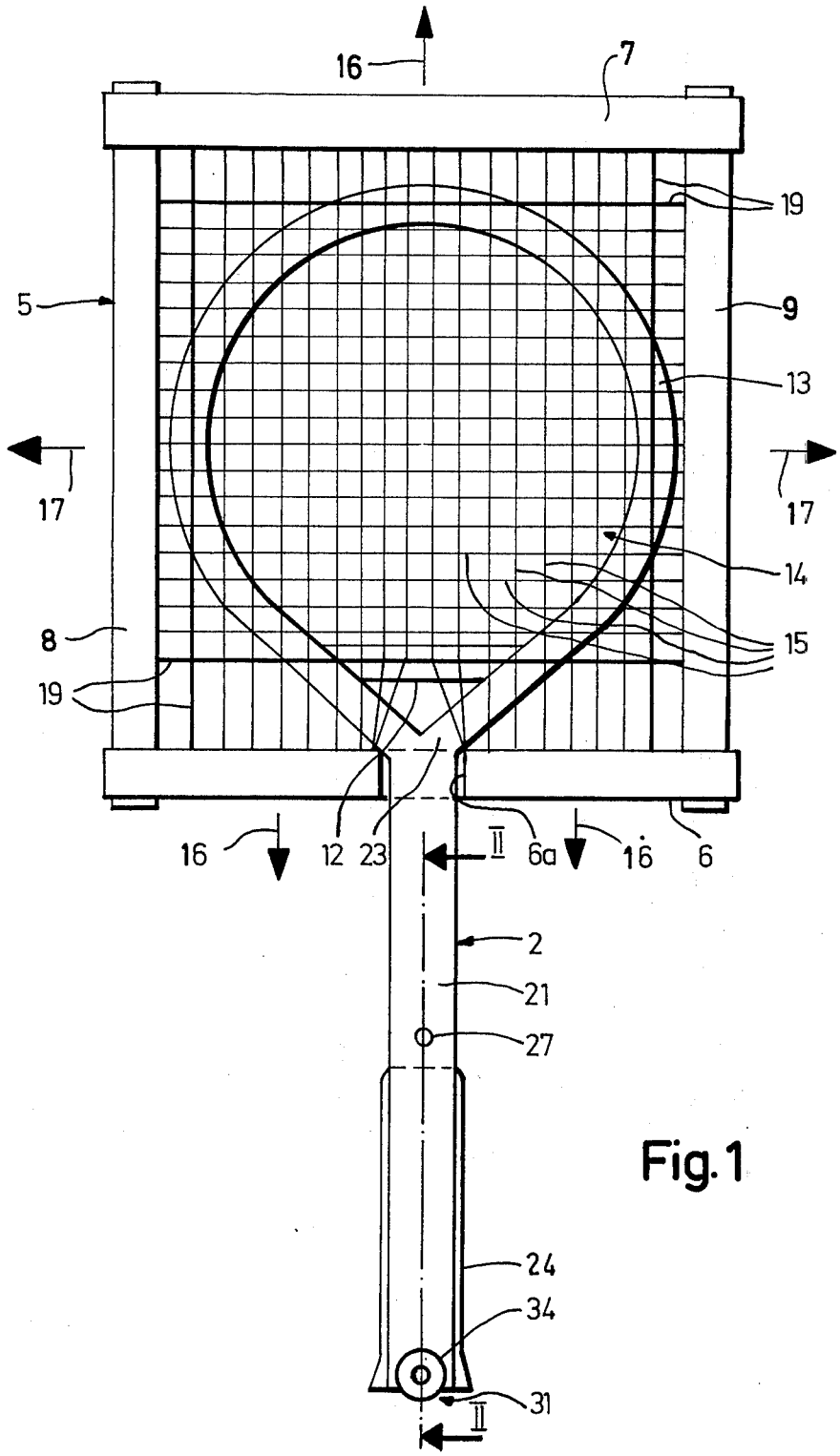
FIG. 1 shows a plan view of a string netting to which tension is being applied by a tensioning device, and illustrates a half frame member of a tennis racket arranged under the netting.
Figure 2:
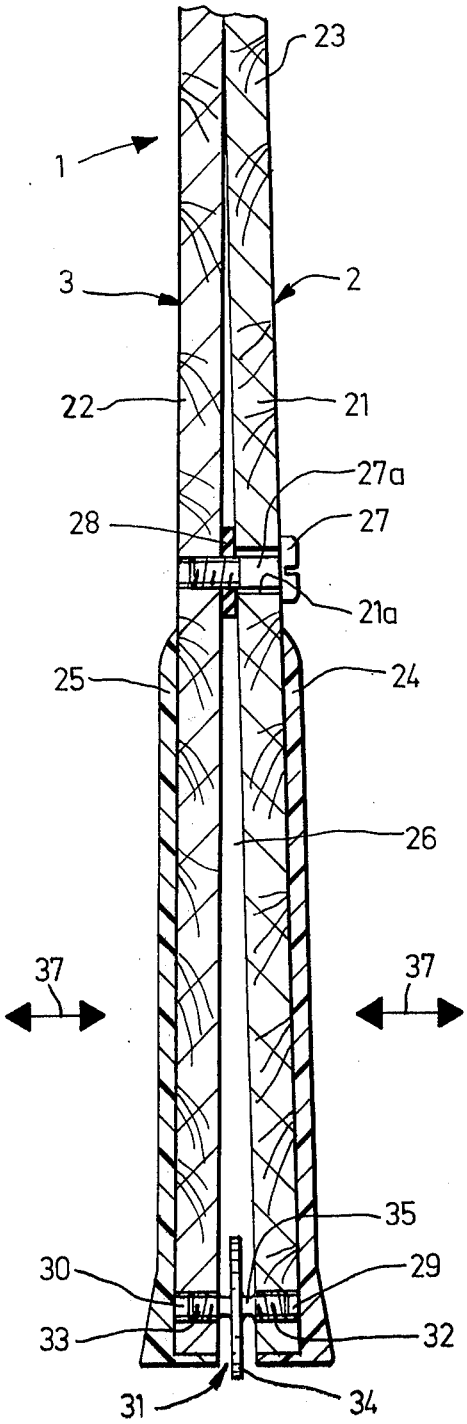
* and FIG. 2 shows on an enlarged scales a section through the handle of the racket along the line II—II in FIG. 1.

Referring now to the accompanying drawings, a tennis racket is provided with a frame 1, which is formed by two substantially identical half frame members 2 and 3, of which, in FIG. 1, only the half frame member 2 and in FIG. 2, only the parts 21 and 22 forming the handle of the racket are shown. The half frame members may be of multi-layer wood, or of light metal, or of reinforced synthetic material. The half frame member 2 comprises a generally annular portion 13 connected with the handle part 21 by a heart-shaped portion 23. The heart-shaped portion 23 at its upper end includes a reinforcing element 12 formed by a plate or a stay. This can be formed either by a portion of the half frame member 2 contiguous with the rim element defined by the generally annular portion 13 or by a separate element glued to the half frame member. The half frame member 3 is similar to the half frame member 2 and is also provided with a generally annular portion, which is constructed as an exact mirror image of the portion 13. The two generally annular portions of the respective half frame members 2 and 3 together form the rim of the frame 1. A netting, which is indicated generally by a reference numeral 14 and which is formed by strings 15, is clamped between the two generally annular portions 13. The strings consist of threads of natural fibres and/or fibres of synthetic material. The generally annular portions 13 are disposed upon one another and are adhesively bonded to one another and to the strings is by a suitable binding means, such as glue.

The two handle parts 21 and 22 of the respective half frame members together form the handle of the racket and each is provided at its free ends with a respective coating 24 or 25 of synthetic material. These two coatings of synthetic material together form the hand grip of the handle. The two handle parts 21 and 22 are separated from one another by a gap 26 from which the binding means is excluded along a substantial predetermined longitudinal portion of the handle extending up to the free end of the handle. The handle parts 21 and 22 are connected with one another by a screw 27 in the proximity of the upper ends, in FIG. 2, of the coatings 24 and 25. The screw 27 is screwed into the handle part 22 and passes through a washer in the form of a spacer element 28, which is arranged in the gap 26 and which preferably consists of resilient rubber. The screw 27 is provided with a threadless shank 27*a*, which passes through a bore 21*a* in the handle part 21. The diameter of the bore 21*a* is somewhat larger than that of the screw shank 27*a*, so that both handle portions 21 and 22 can spring somewhat in the region of the screw 27. A further washer or spacer element 31, which simultaneously serves as a connecting element, is arranged at the free end of the handle. The spacer element 31 is provided with a round disc 34 in the middle and with a threaded bolt 32 or 33 at each end. The threaded bolts 32 and 33 are provided with threads of opposite sense and each is screwed into a respective threaded bore 29 or 30 in the parts 21 and 22. The spacer element 31 consists of an elastic material, for example of polyamide or polyacetal. It is furthermore provided with annular grooves 35 on both sides of the disc 34 to increase its flexibility. The diameter of the disc 34 is so dimensioned that it projects somewhat beyond the end surface and/or the lateral surfaces of the handle. Furthermore, the disc 34 is expediently knurled, so that it provides means for adjusting the spacer element 31. It is thus displaceable to vary the width of the gap between the two handle parts 21 and 22. A tennis player using the racket can therefore set the thickness and the spreading angle of the hand grip as desired within predetermined limits.

The gap 26 between both handle parts 21 and 22 and their elastic connection make it possible for both handle parts 21 and 22 to be resiliently displaceable in the direction indicated by the double arrows 37. This feature tends to enhance the effectiveness of the racket and to dampen any shocks transmitted to the arm of a player holding the racket. The loading of the joints, muscles and sinews of such player may thereby be appreciably The gap between the handle parts 21 and 22 ensures that the surface of the hand grip is slightly greater than with a solid hand grip of the same weight and cross-section of material. The capacity of the hand grip to absorb hand perspiration is thereby substantially increased. The coatings 24 and 25 advantageously consist of a soft synthetic material having open pores.

Figure 1A:
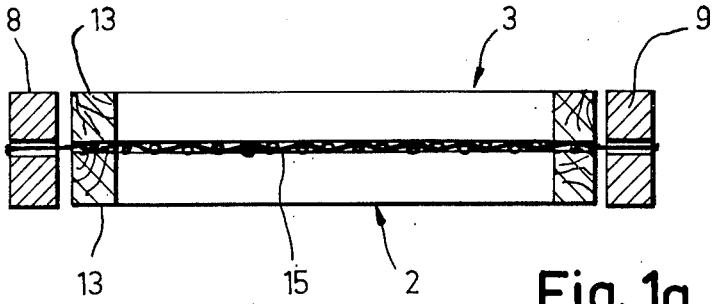
FIG. 1*a* is a transverse sectional view of FIG. 1.

Manufactured first in the production of the racket are the two half frame members 2 and 3. As previously stated these may each consist of wood or of any other suitable material. A tension applicator device, indicated generally by the reference numeral 5 and illustrated in FIG. 1, and partly in FIG. 1*a* is employed in the course of the manufacture of the racket. The tension applicator device is provided with two mutually parallel tensioning strips 6 and 7 and two mutually parallel tensioning strips 8 and 9, which together form a rectangular frame. The four tensioning strips 6, 7, 8 and 9 are provided with means to firmly retain the strings 15 which are interwoven with one another. Furthermore, the tensioning device includes adjusting means (not shown) such as screws or hydraulic actuator, to urge or to draw the two strips 6 and 7 away from one another as indicated by the arrows 16. Similarly, the two strips 8 and 9 are also loaded by forces directed away from one another, which are indicated by the arrows 17. Thereby, all the strings are evenly tensioned. Now, the generally annular portions 13 of each of the half frame members 2 and 3, or at least their mutually facing surface portions, are covered with binding means and laid upon one another in such a manner that the strings 15 intended to form the netting 14 are clamped fast between them. As is evident from FIG. 1, the strip 6 is provided with a recess 6*a*, into which the handle of the racket can be laid. Then, both frame members 2 and 3 are pressed against one another by a press device (not shown), whilst the strings are naturally pressed somewhat into the frame halves. When the two frame halves and the strings are firmly connected with one another by the binding means, the tensioning strips 6, 7, 8 and 9 can be released and the racket be separated from the tensioning device. The ends of the strings projecting beyond the frame can then be removed by grinding away, or in any other suitable manner.

So that the strings are firmly secured to the frame, the strings should be provided with a somewhat rough, porous surface. They should furthermore consist of a material to which the binding material is readily adhesive. Woven threads, which are formed of several untreated natural fibres and/or fibres of synthetic material have proven to be particularly suitable. Threads provided with a dressing can however also be employed for the formation of the strings.

In case the strings are formed of fibrous materials of untreated surface, it is expedient for an increase of their life to provide them with a protective coating of, for example, synthetic material. This coating can be formed by applying the binding means before the two frame halves are placed over one another not only to the respective generally annular portions but also to the strings. After drying, this binding material then forms the coating and connects the strings with one another in pairs at their crossing points. This has the advantage that the strings cannot be displaced relatively to one another during playing. Moreover, such cross-connecting tends to ensure that the netting generally remains intact even on the tearing of an individual string, so that the racket is always still usable.

Figure 1B:
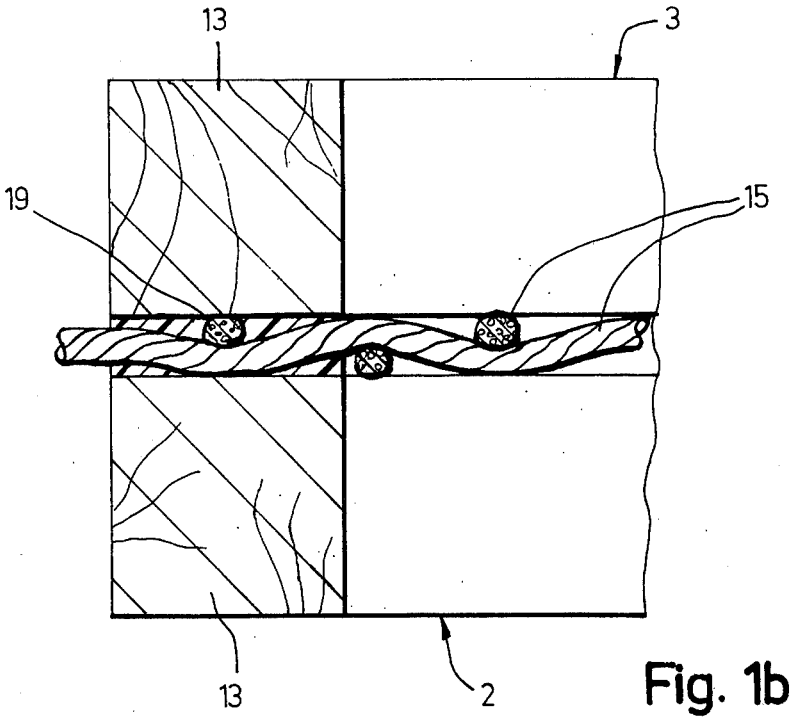

As is evident from FIG. 1, the strings 15 forming the netting 14 form crossing points at certain regions of the rim element defined by the generally annular portions 13. By contrast, the strings 15 form no crossing points in other regions of the rim element. Without special measures, this would have the consequence that the strings 15 would be more strongly clamped fast between the rim elements in the regions with crossing points than in the regions without crossing points. This could in the case of strong loadings, to individual strings being pulled out. This danger is now countered in that, additionally to the strings 15 forming the netting 14, strings 19 are provided which, after the completion of the racket, are completely embedded between the two rim elements 13 and/or the reinforcing parts 12 of the heart-shaped elements 23. The strings 19 are for emphasis shown somewhat thicker in FIG. 1, while in reality they are, however, of substantially the same thickness as the strings 15, as is shown in FIG. 1*b*. It is thus ensured that all strings extending between the two generally annular ring elements 13 and/or the two reinforcement parts 12 of the heart-shaped element 23 cross over one another.

The diameter of the strings is preferably about 1.5 millimeters in the case of the tennis racket. Each string should then be tensioned by a force of at least about 15 kiloponds. For shuttlecock rackets, the strings may be of smaller diameter. The tensioning force may consequently be reduced proportionally to the cross-section of the strings, so that a tensile stress of at least about 8 kiloponds per square millimeter results.

The rackets and their manufacture can of course be modified in different respects. For example, lack half frame member and the strings may each consist of synthetic material, which by application of suitable solvent means is slightly dissolved in the edge zone. When the half frame members are then pressed against one another, the treated edge zones connect one another. Thus, not only an adhesive substance but also solvent means may serve as the binding means. The invention is applicable not only to tennis rackets, but also to rackets for other games, such as, for example, shuttlecock, badminton and squash tennis.

Although the rim element of the racket specifically described has been designated as comprising generally annular portions of the respective half frame members, it will be appreciated that the rim element of a racket embodying the present invention may be other than generally circular, for example rackets with oval or oblong netted zones may be used in some games or pastimes.

While a specific embodiment of the invention has been shown and described in detail to illustrate the application of the principles of the invention, it will be understood that the invention may be embodied otherwise without departing from such principles.

I claim:

1. A method of manufacturing a games racket comprising the step of providing two, substantially mating, half-frame members having open rim portions; providing a plurality of individual substantially coplanar uncoated strings of a non-metallic material selected from the group consisting of natural and synthetic fibers; conjointly applying tension to all of the coplanar uncoated strings; while the strings are conjointly tensioned, pressing the strings between the two substantially mating open rim portions of the respective substantially mating half-frame members; and applying a bonding agent to inseparably bond the conjointly tensioned uncoated strings to both said open rim portions and the two open rim portions to each other.

2. A method of manufacturing a games racket, as claimed in claim 1, including the step of, simultaneously with the binding operation, fully coating the strings with the bonding agent.

3. A games racket comprising two individual substantially mating frame members each provided with a respective open rim portion and with a respective handle part connected to the associated open rim portion; a plurality of initially uncoated individual strings, of a non-metallic material selected from the group consisting of natural and synthetic fibers crossed to define a netting, fixed between said open rim portions while said strings are conjointly tensioned, and a bonding agent securing said two open rim portions to each other and to said netting.

4. A games racket comprising two individual substantially mating frame members each provided with a respective open rim portion and with a respective handle part connected to the associated open rim portion; a plurality of initially uncoated individual strings, of a non-metallic material selected from the group consisting of natural and synthetic fibers crossed to define a netting, fixed between said open rim portions while said strings are conjointly tensioned; a bonding agent securing said two open rim portions to each other and to said netting; said racket frame members being bonded to each other and to said strings along substantially only said open rim portions and being free of each other along at least predetermined longitudinally extending portions of said handle parts to define a gap extending parallel to the plane of said netting; and at least one spacer element engaged between said longitudinally extending portions of said handle parts.

5. A racket as defined in claim 4, including adjustable spacer means engaged between said longitudinally extending portions of said handle part adjacent the outer free ends thereof to vary the width of said gap between said longitudinally extending portions of said handle parts to set the thickness and the spreading angle of the hand grip, as desired, within predetermined limits.

6. A racket as defined in claim 6, wherein said adjustable spacer means comprises an elongate member provided with respective threaded portions at opposite ends thereof, each threaded portion co-operating with a correspondingly threaded bore in a respective one of said handle parts, said threaded portions of said elongate member being threaded in opposite senses.

* * * * *